US005385419A

United States Patent [19]

Noguchi

[11] Patent Number: 5,385,419

[45] Date of Patent: Jan. 31, 1995

[54] FASTENER

[75] Inventor: Kanji Noguchi, Tokyo, Japan

[73] Assignee: Shilogane Kasei Co., Ltd., Tokyo, Japan

[21] Appl. No.: 71,578

[22] Filed: Jun. 2, 1993

[30] Foreign Application Priority Data

Jun. 19, 1992 [JP] Japan ..... 4-042436[U]

[51] Int. Cl.[6] ..... B42F 13/00

[52] U.S. Cl. ..... 402/75

[58] Field of Search ..... 402/75

[56] References Cited

U.S. PATENT DOCUMENTS

| | | | |
|---|---|---|---|
| 3,792,544 | 2/1974 | Foley | 402/4 |
| 3,867,743 | 2/1975 | Corey | 402/14 |
| 4,285,104 | 8/1981 | Corey et al. | 402/14 |
| 5,002,416 | 3/1991 | Serzen | 402/74 |
| 5,059,051 | 10/1991 | Corey | 402/80 R |

*Primary Examiner*—P. W. Echols

*Attorney, Agent, or Firm*—David O'Reilly

[57] ABSTRACT

A fastener comprised of a base having tongue-shaped strips, an adhesive layer attached to the base and covered with a detachable sheet or at least one synthetic resin sheet. To utilize the fastener, the detachable sheet is stripped from the adhesive layer, or the synthetic resin sheet is melted, securing the base to the attaching surface of a file etc. by the bonding force of the adhesive layer or by the heat-welding of the synthetic resin sheet. In alternate embodiment the base and tongue-shaped strips are encapsulated between two synthetic sheets with the adhesive surface being on one of the sheets. Detachable release sheet is applied to the adhesive layer until ready for use.

4 Claims, 3 Drawing Sheets

FASTENER

BACKGROUND OF THE INVENTION

This invention is related to fasteners which can be secured to the surface of a cover of a file, wall, etc. for binding sheets, such as loose leaf pads, pieces of paper having a plurality of holes, plastic films or sheets of paper, all that are referred to as sheets etc. hereinafter.

In conventional files, fasteners have a base with tongue-shaped strips secured to the surface of a cover of the files by a stopper. The tongue-shaped strips pass through holes of sheets etc., such as loose leaf paper and in turn through holes of a holder. The strips are held down by sliders which are slidably mounted in the holder and result in the sheets being bound.

Another type of file has a folded portion at a boundary between a cover and a backbone of the files. On the folded portion a base with tongue-shaped strips is secured.

However, files of the former type, since the base or stopper is exposed outside of the cover, it does aesthetic harm to the files. Also since some files need holes so that the tongue-shaped strips can pass through them, manufacturing then takes a lot of time and steps, and costs are entailed.

In files with folded portion of the latter type, since the base or stopper is not exposed outside of the cover, it looks better than the former type of files. However, they need the folded portion and stopper for the base. Also some files need holes so that the tongue-shaped strips can pass through them. As a result manufacturing then takes a lot of time and steps, and costs are entailed.

SUMMARY OF THE INVENTION

Accordingly, it is an object of the invention to provide a fastener which is easily adapted to be secured to the surface of a file or wall for binding sheets etc. so as to overcome the disadvantages of known art.

The fastener according to the invention comprises a base having tongue-shaped strips, an adhesive layer attached to the base and a detachable sheet covering one surface of the adhesive layer. When utilizing the fastener, the detachable sheet is stripped from the adhesive layer, and then the base is secured on the surface of files etc. by the bonding force of the adhesive layer.

Alternatively, the fastener further comprises at least one synthetic resin sheet attached to the base.

Alternatively, the fastener comprises at least one synthetic resin sheet instead of the adhesive layer. When utilizing the fastener, the base can be secured on the surface of files etc. by heat-welding the synthetic resin.

Still alternatively, the synthetic resin sheets are bonded to each other to enclose or encapsulate the base on either side thereof with the tongue-shaped strips projecting from the base and the fastener further comprises an adhesive layer provided on one of the synthetic resin sheets and a detachable sheet covering one surface of the adhesive layer.

Alternatively a two part cover sheet may be used having cut ends meeting at a cut line traverse to a central portion of the other synthetic resin sheet.

Because the fastener according to the invention comprises an adhesive layer or synthetic resin, the base or the stopper is never exposed outside of the file. In addition, because the fastener does not require a folded portion of the file nor holes through which the tongue-shaped strips should pass, manufacturing is simple and cost is reduced.

Other objects and advantages and novel features of the invention will become more apparent from the following portion of this specification and the accompanying drawings.

DESCRIPTION OF THE PREFERRED EMBODIMENTS

Figure 1A:
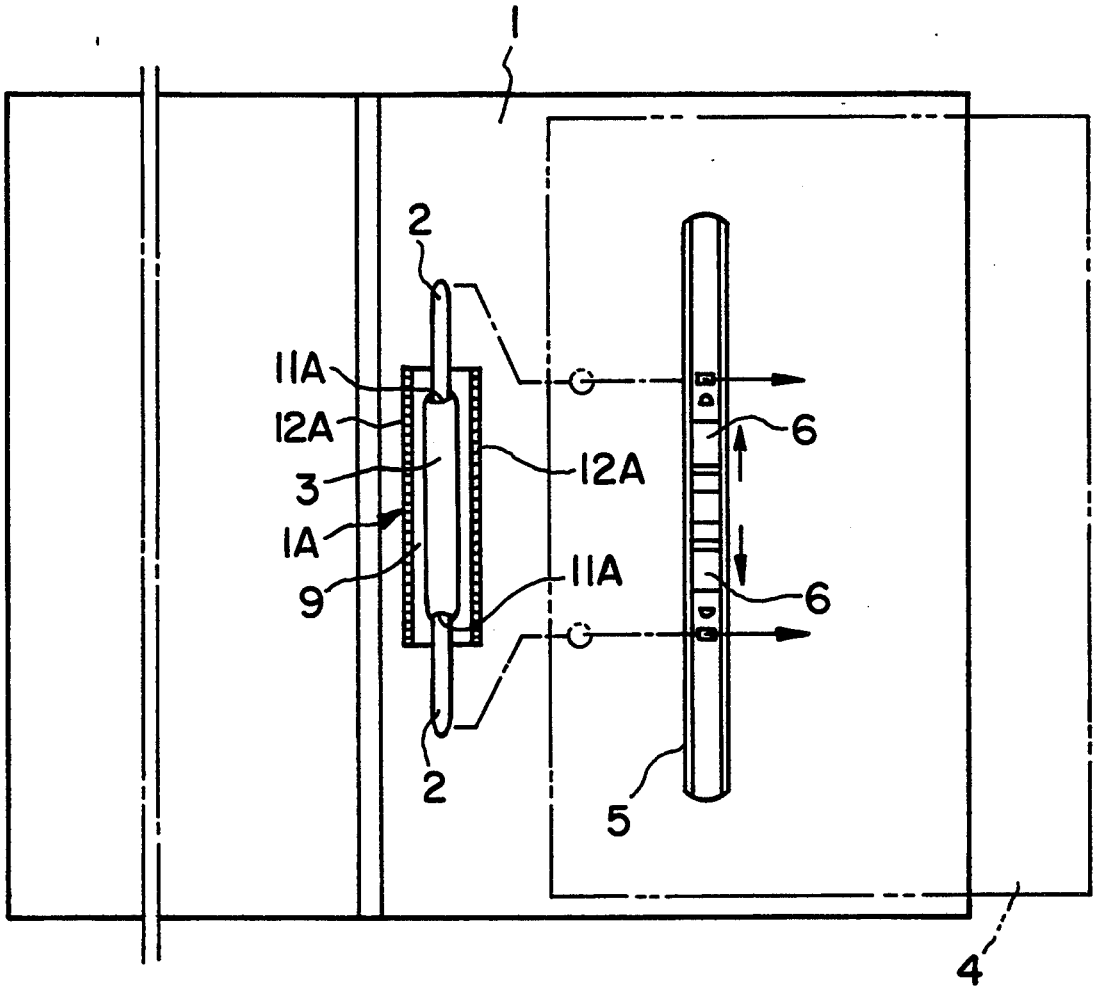
FIG. 1(A) is a front view of one embodiment of the fastener according to the invention.

In FIG. 1(A), the fastener generally includes base 3 and synthetic resin sheet 9 attached to base 3. Base 3 has a pair of tongue-shaped strips 2, 2 at either ends thereof which extend outward from beneath the synthetic resin sheet 9 through slits 11A, 11A. Base 3 is disposed at a central position 1A of back surface 1 of the cover of a file along the backbone of the file. If the cover is made of synthetic resin, the attachment for base 3 to attaching surface 1 is made by heat-welding either edge 12A, 12A of synthetic resin sheet 9 with the tongue-shaped strips 2, 2 projecting outwards from sheet 9 through slits 11A, 11A.

Holder 5, which can be made of synthetic resin or metal, has a pair of holes and a pair of sliders 6, 6 slidably mounted on holder 5. Sliders 6, 6 can be also made of synthetic resin or metal. The holder 5 and sliders 6, 6 used may be those known in the art.

When binding loose leaf pad 4, tongue-shaped strips 2, 2 pass through punched holes of loose leaf pad 4 and in turn through holes of holder 5. Then sliders 6 are moved away from each other in the directions denoted by the arrows in FIG. 1(A) so as to hold down the tongue-shaped strips 2, 2 respectively, resulting in loose leaf pad 4 being bound.

Figure 1B:
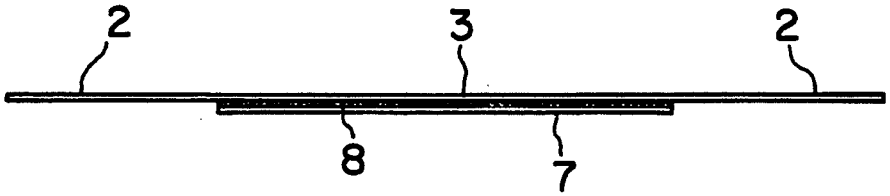
FIG. 1(B) is a longitudinal sectional side view of another embodiment of the fastener according to the invention.

In FIG. 1(B), a fastener generally includes base 3 having a pair of tongue-shaped strips 2, 2 at either ends thereof, adhesive layer 8 and detachable sheet 7 covering one surface of adhesive layer 8. When the cover is made of paper, it is effective to utilize this type of a fastener. Detachable release sheet 7 is stripped from adhesive layer 8 so that the fastener can be secured on attaching surface 1 by the bonding force of adhesive layer 8. The fastener of FIG. 1(B) is also used when the cover is made of synthetic resin.

Figure 2A:
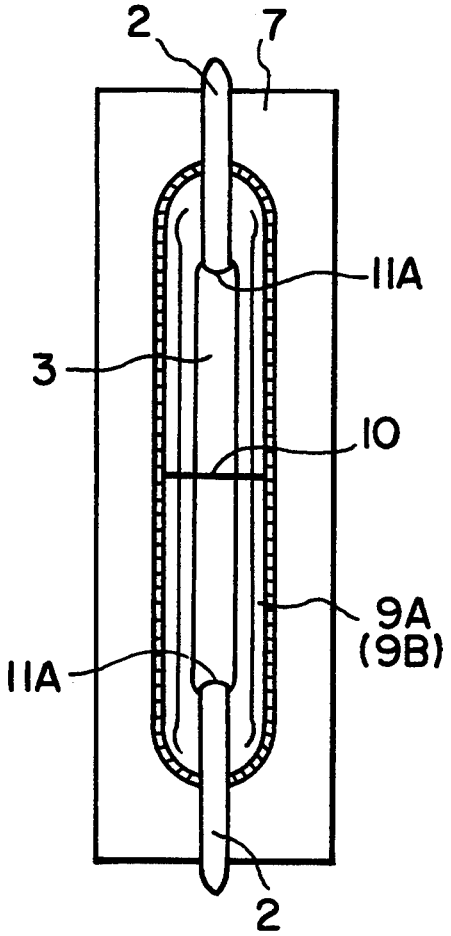
FIG. 2(A) is a front view of third embodiment of the fastener according to the invention.
Figure 2B:
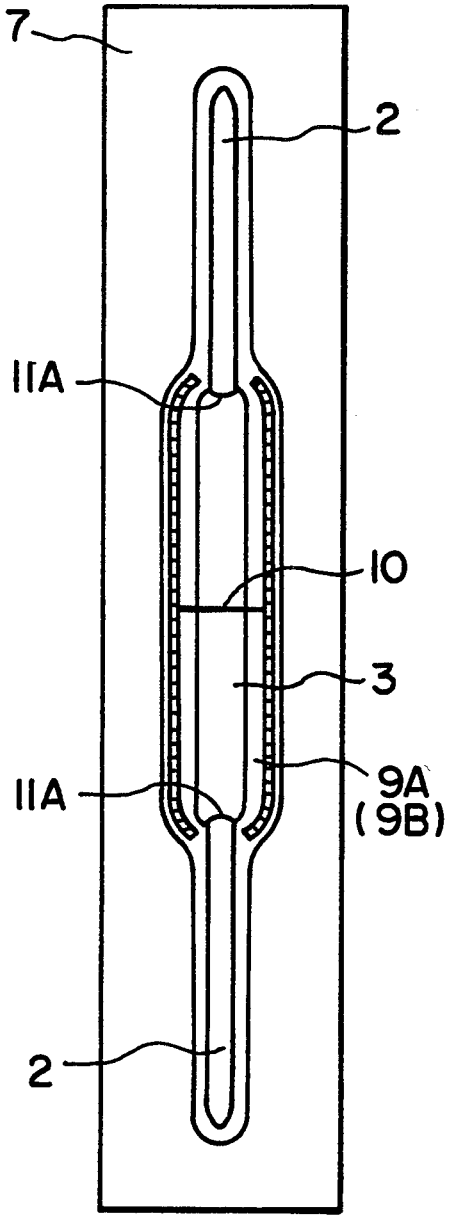
FIG. 2(B) is a front view of fourth embodiment of the fastener according to the invention.
Figure 3A:
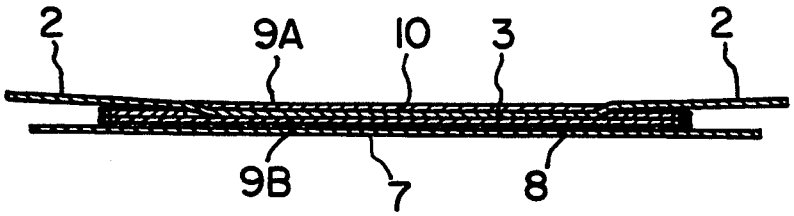
FIG. 3(A) is a longitudinal sectional side view of the fastener shown in FIG. 2(A)
Figure 3B:
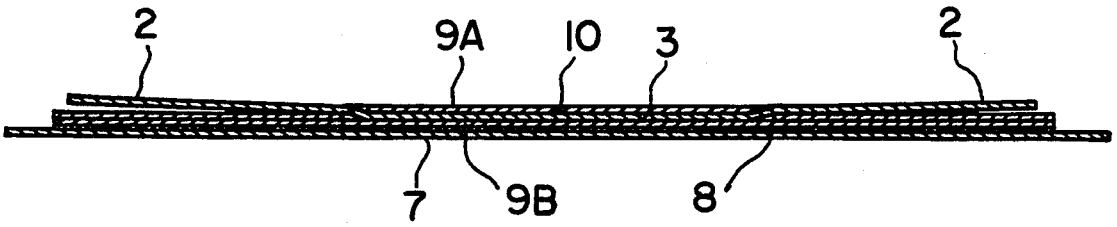
FIG. 3(B) is a longitudinal sectional side view of the fastener shown in FIG. 2(B).

FIGS. 2(A) and 2(B) show other embodiments of the fastener according to the invention, and FIGS. 3(A) and 3(B) are longitudinal sectional side views corresponding to FIGS. 2(A) and 2(8) respectively.

In these embodiments, synthetic resin sheets 9A, 9B are bonded to each other by radio-frequency welding at the edges to enclose base 3 on either side thereof with tongue-shaped strips 2, 2 projecting from inside defined by sheets 9A, 9B through slit 11A, 11A. If base 3 is made of metal, synthetic resin sheet 9A on the front side of the base 3 is preferably made of two parts. Before bonding sheet 9A with sheet 9B by radio-frequency welding, each end of a two-part synthetic resin sheet 9A can easily pass over each tongue-shaped strip 2, 2. In other words, each end of a two-part synthetic resin sheet 9A can be introduced from either side of the base 3 without bending base 3 which has less flexibility. After bonding, cut line 10 formed by cut ends of two part cover sheet 9A extends traverse to a central portion of the synthetic sheets and remain as a boundary between them.

On the back side of base 3, adhesive layer 8 with detachable sheet 7 is provided on synthetic resin sheet 9B. The fastener can be secured at the central position 1A of the back of a cover attaching surface 1 of a file along the backbone of the file by adhesive layer 8 after stripping detachable release sheet 7 therefrom.

The embodiments of FIGS. 2(A) and 2(B) can be applied to a cover made of either paper or synthetic resin.

If base 3 having tongue-shaped strips 2, 2 is made of synthetic resin, synthetic resin sheet 9A can be made of one piece. Because base 3 itself is flexible and each tongue-shaped strip 2, 2 can pass through the holes of synthetic resin sheet 9A easily. Therefore, there is no need for dividing cutting line 10 on synthetic resin sheet 9A.

While the principles of the invention have been described above in connection with specific embodiments, and particular modifications thereof, it is to be clearly understood that this description is made only by way of example and not as a limitation on the scope of invention but only in accordance with the scope of the appended claims.

What is claimed is:

1. A fastener adapted to be secured to an attaching surface for binding up sheets in cooperation with a holder having holes and sliders slidably mounted on the holder, said fastener comprising;

a base having tongue-shaped strips, said tongue-shaped strips being adapted to pass through holes of sheets and in turn, through holes of said holder to be held down by said sliders so that said tongue-shaped strips are secured to bind said sheets;

a pair of synthetic resin sheets bonded to each other along the respective edges by heat melting to encapsulate said base on either side thereof with said tongue-shaped strips projecting from said base;

an adhesive layer provided on one of said synthetic resin sheets; and a detachable sheet covering the surface of said adhesive layer so that said base can be secured to said attaching surface by said adhesive layer when said detachable sheet is stripped off;

whereby said fastener may be secured to a surface for binding up sheets.

2. The fastener according to claim 1 wherein a top sheet of said pair of sheets is divided into two parts formed by cut ends forming a cut line traverse to a central portion of the other synthetic sheet.

3. A fastener adapted to be secured to an attaching surface for binding sheets to a file, said fastener cooperating with a holder having holes on each end clamping sliders mounted on said holder, said fastener comprising;

a base having tongue-shaped strips extending from each end, said tongue-shaped strips adapted to pass through holes punched in sheets to be stored in said file and through said holes in said holder to be securely clamped down by said sliders to bind sheets stored in said file;

a pair of synthetic resin sheets bonded to each other by heat melting along the edges thereof to encapsulate said base of said fastener with said tongue-shaped strips extending through slits in one of said synthetic resin sheets;

said synthetic sheet having the slits being comprised of a synthetic sheet divided into two parts, said two parts being positioned over said fastener before said synthetic sheets are sealed to encapsulate said base;

an adhesive layer formed on an outer surface of the other of said synthetic sheets;

detachable release sheet means covering said adhesive layer until ready for use;

whereby said detachable release sheet may be stripped off and said adhesive layer pressed on an attaching surface of said file to secure said synthetic sheets and encapsulated base to the attaching surface of said file.

4. The fastener according to claim 3 in which said synthetic sheet having the slits is comprised of a synthetic sheet divided into two parts, said two parts being positioned over said fastener before said synthetic sheets are sealed to

* * * * *